United States Patent [19]

Canivet

[11] Patent Number: 4,555,898

[45] Date of Patent: Dec. 3, 1985

[54] APPARATUS FOR STRANDING ARMOR WIRES ABOUT A CABLE CORE, AND METHOD IMPLEMENTED BY THE APPARATUS

[75] Inventor: Jean-Luc Canivet, Oye Plage, France

[73] Assignee: Les Cables de Lyon, France

[21] Appl. No.: 643,325

[22] Filed: Aug. 22, 1984

[30] Foreign Application Priority Data

Aug. 22, 1983 [FR] France ..... 83 13539

[51] Int. Cl.[4] ..... D07B 7/02; D07B 7/06

[52] U.S. Cl. ..... 57/19; 57/13

[58] Field of Search ..... 57/3, 6, 9, 11, 13, 57/17, 18, 19, 78, 80

[56] References Cited

U.S. PATENT DOCUMENTS

| | | | |
|---|---|---|---|
| 3,659,406 | 5/1972 | Kipperberg | 57/19 |
| 3,727,390 | 4/1973 | Schwurz | 57/19 X |
| 3,736,739 | 6/1973 | Walter | 57/19 X |
| 4,212,151 | 7/1980 | Schaufelle et al. . | |
| 4,237,687 | 12/1980 | Vecchis et al. | 57/13 X |
| 4,309,864 | 1/1982 | Hulin | 57/352 X |

FOREIGN PATENT DOCUMENTS 2458086 5/1979 France .

*Primary Examiner*—Donald Watkins

*Attorney, Agent, or Firm*—Sughrue, Mion, Zinn, Macpeak & Seas

[57] ABSTRACT

Apparatus (1) for stranding armor wires (11) about a cable core (10), the apparatus comprising a rotary plate (2) equipped with armor wire bobbins (3), a rotary distributer grid (4) driven by the plate, and a stranding die (5) for bringing together the armor wires around the cable core. The improvement lies in the apparatus including a coupling (20) situated between the plate and the distribution grid, together with a brake (40) for stopping the distribution grid. If a stranding operation is interrupted, the distribution grid is braked and stopped in time with the cable core stopping its longitudinal movement, leaving the plate to continue to rotate for a turn or more under its own inertia. Excess twist is thus prevented from crushing the cable core.

5 Claims, 1 Drawing Figure

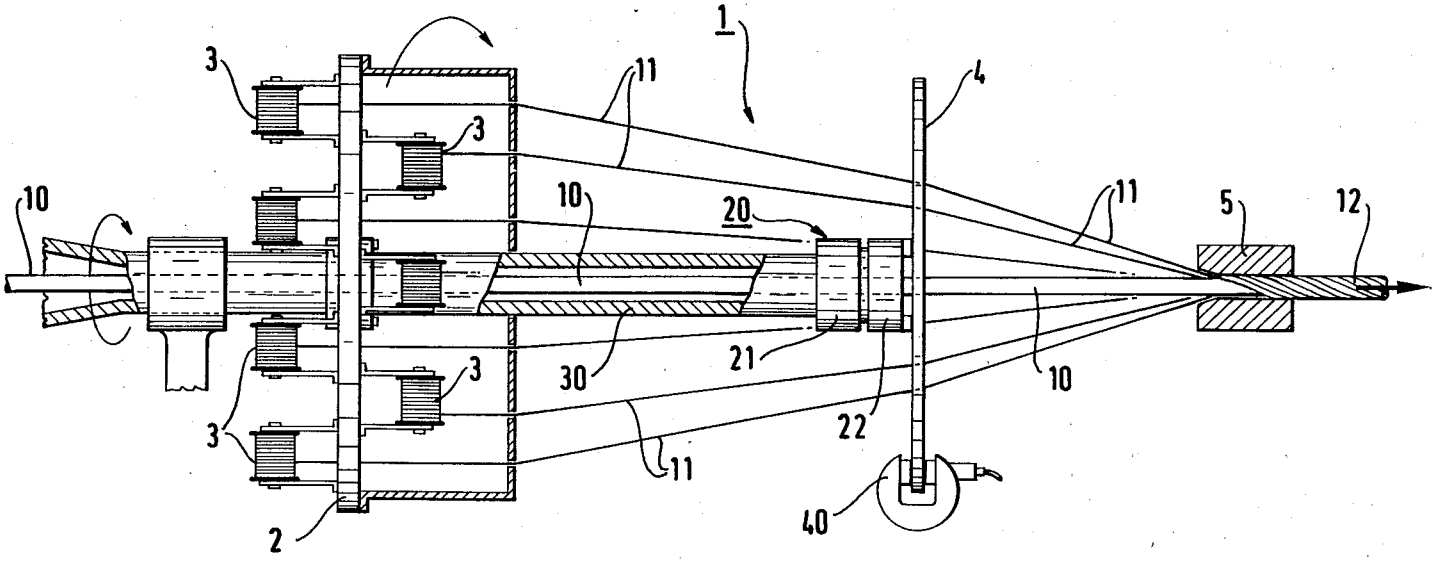
12
5
11
10
4
22
40
1
20
21
11
11
10
30
3
3
2
3
3
10

APPARATUS FOR STRANDING ARMOR WIRES ABOUT A CABLE CORE, AND METHOD IMPLEMENTED BY THE APPARATUS

The present invention relates to apparatus for stranding armor wires about a cable core, the apparatus comprising a rotary plate equipped with armor wire bobbins, a rotary distributer grid driven by the plate, and a stranding die for bringing together the armor wires around the cable core. The invention also relates to a method implemented by the apparatus.

BACKGROUND OF THE INVENTION

In strander-twisters for stranding armor wire about a central cable core, the wires are generally stored on bobbins and are then guided via a rotary distribution grid prior to being brought together by a die around the central core which is moving longitudinally.

In such prior strander-twisters, the distribution grid turns uniformly to lay the wire helically around the central core, and if the stranding operation is interrupted and the strander is stopped, the inertia of the rotary plate continues to turn the grid after the cable has stopped, since the inertia of the cable drive mechanism is less than that of the plate. There is thus a portion of excessive twisting about the core, in which the armor wires tend to crush the core, and this can be damaging, particularly in optical fiber cables. The excessive twisting is naturally untwisted when the strander restarts, but permanent damage may already have been done.

Preferred embodiments of the present invention ensure that the distributer grid and the cable core come to rest simultaneously, thereby avoiding excessive twisting.

SUMMARY OF THE INVENTION

The present invention provides apparatus for stranding armor wires about a cable core, the apparatus comprising a rotary plate equipped with armor wire bobbins, a rotary distributer grid driven by the plate, and a stranding die for bringing together the armor wires around the cable core, the improvement wherein the apparatus includes a coupling situated between the plate and the distribution grid, together with a brake for stopping the distribution grid.

Advantageously the coupling is constituted by two separable portions.

The coupling may be constituted by a torque limiter, a clutch, or an electromagnetic coupler.

The method in accordance with the invention, in which armor wires are helically wound around a longitudinally moving cable core, includes the improvement wherein, in the event of the stranding operation being interrupted, the distribution grid is stopped and mechanically separated from the rotating plate, thereby preventing excess twisting of the armor wires around the stationary cable core, with the excess twisting taking place between the distribution grid and the plate while it continues to rotate under the effect of its own inertia.

Advantageously, the distribution grid brake is controlled by the cable core stopping.

Preferably, in order to restart the cabling operation, the plate is turned in the opposite direction to untwist the excess twist, the distribution grid brake is then released so that both parts are re-coupled, and the stranding operation is restarted by reversing the direction of plate rotation a second time.

BRIEF DESCRIPTION OF THE DRAWING

An embodiment of the invention is described by way of example with reference to the accompanying drawing in which the sole FIGURE is a diagrammatic side view of stranding apparatus in accordance with the invention.

MORE DETAILED DESCRIPTION

Stranding apparatus 1 comprising a rotary stranding plate 2 on which bobbins 3 of armor wire are mounted. A rotary distribution grid 4 holds the armor wires 11 apart, and a die 5 brings the armor wires 11 together around a core 10, thereby forming a cable 12.

The distribution grid 4 is mechanically connected to the rotary plate 2 by a coupling 20 comprising two separable portions 21 and 22. The portion 21 is connected by a tube 30 to the plate 2, while the portion 22 is connected to the distribution grid 4. Advantageously the diameter and the length of the central tube 30 are calculated to avoid producing any permanent deformation in the steel armor wires 11 when excess twisting takes place. The two portions of the coupling are coupled together during a stranding operation, and they are uncoupled from each other at the moment the brake is applied to the distribution grid since the torque exerted on the rotating plate is very high at that moment. A disk brake 40 is mounted to engage the periphery of the distribution grid 4 and is controlled by the cable's longitudinal movement and stopping.

The stranding plate is rotated and the cable is pulled longitudinally by independent mechanical means which are caused to move in concert by electrical means. The inertia of the means for rotating the stranding plate is greater than the inertia of the means for pulling the cable.

A stranding operation thus takes place as follows:

The cable core moves longitudinally and passes through the stranding apparatus 1 from end to end;

At the same time the stranding plate 2 is rotated and consequently rotates the distribution plate 4, causing the armor wires 11 to be wound helically around the core in the die 5;

If the stranding operation is interrupted, the cable core stops almost instantaneously because of its low inertia, and the cable stopping automatically causes the brake to act on the distribution grid 4 (control means capable of detecting the cable stopping and of actuating the brake in consequence are known);

Once the brake is applied to the distribution grid 4, the coupling 20 disengages it mechanically from the plate, which continues to rotate, maybe for several turns, by virtue of its high inertia;

The excess twist is thus located between the plate 2 and the distribution grid 4, and the cable core 10 is thus protected by the tube 30;

The coupling may disengage automatically if it is constituted by a conventional torque limiter, for example, or else it may positively controlled to disengage at the same time as the brake is applied, if it is a clutch, for example;

To restart the stranding operation, the distribution grid brake is held on, the plate is made to rotate slowly backwards to re-align the armor wires, and once the wires are re-aligned the two portions of the coupling are recoupled to each other, either automatically if a torque limiter, or by independent control if a clutch;

The brake is then released from the distribution grid, and the stranding operation is restarted by simultaneously setting both the cable core and the rotary plate in motion (the plate is naturally reversed a second time so that it continues to strand in the original stranding direction).

The apparatus and the method of the invention is applicable to any strander-twister which helically twists wires around a covered or a smooth cable core for electricity, for optical fibers, or for other purposes, and the distribution grid may include means for pre-forming the wires, for example.

I claim:

1. Apparatus for stranding armor wires about a cable core, said apparatus comprising a rotary plate equipped with armor wire bobbins bearing armor wire, a rotary distributer grid, means connecting said grid to said plate such that said grid is driven by the plate, and a stranding die for bringing together the armor wires around the cable core, the improvement wherein said means connecting said grid to said plate includes a detachable coupling situated between the plate and the distribution grid, and a brake for stopping the distribution grid when said grid is uncoupled from said plate.

2. Apparatus according to claim 1, wherein the coupling is constituted by two separable portions.

3. In a method of stranding armor wires about a cable core including the steps of rotating a rotary plate equipped with armor wire bobbins bearing armor wire about a cable core while moving the cable core longitudinally along its axis through said rotary plate, driving a rotary distributor grid via said plate while distributing armor wire from said bobbin and bringing together the armor wires via a stranding die around the cable core to helically wind said armor wires around said longitudinally moving cable core, the improvement comprising the further steps in the event of the stranding operation being interrupted of applying a brake for stopping the distribution grid and mechanically separating said grid from said rotating plate.

4. A method according to claim 3, wherein the distribution grid brake is energized in response to cable core stopping.

5. A method according to claim 3, wherein, in order to restart the cable operation, said method further comprises the steps of turning the plate in the opposite direction to untwist the excess twist, then releasing a distribution grid brake so that both parts are recoupled and then restarting the stranding operation by reversing the direction of the plate rotation a second time.

* * * * *